United States Patent [19]

Blanchard

[11] Patent Number: 4,932,571

[45] Date of Patent: Jun. 12, 1990

[54] FOLDABLE GARMENT DISPLAY DEVICE

[75] Inventor: Russell O. Blanchard, Zeeland, Mich.

[73] Assignee: Batts, Inc., Zeeland, Mich.

[21] Appl. No.: 365,253

[22] Filed: Jun. 12, 1989

[51] Int. Cl.[5] ..... A47G 25/40
[52] U.S. Cl. ..... 223/89; 223/94
[58] Field of Search ..... 223/89, 94, 87, 88

[56] References Cited

U.S. PATENT DOCUMENTS

| | | | |
|---|---|---|---|
| 855,295 | 5/1907 | Fellroth | 223/89 |
| 1,818,193 | 8/1931 | Burde | 223/88 |
| 1,893,519 | 1/1933 | Grozow | 223/88 |
| 1,896,771 | 2/1933 | Dorrill | 223/89 |
| 2,959,332 | 11/1960 | Spitz | 223/94 |
| 3,007,616 | 11/1961 | Zuckerman | 223/89 |
| 4,168,791 | 9/1979 | Clark | 223/94 |

FOREIGN PATENT DOCUMENTS

| | | | |
|---|---|---|---|
| 155288 | 3/1974 | Canada | 223/88 |
| 614129 | 7/1947 | United Kingdom | 223/88 |

*Primary Examiner*—Werner H. Schroeder
*Assistant Examiner*—Bibhu Mohanty
*Attorney, Agent, or Firm*—Price, Heneveld, Cooper, DeWitt & Litton

[57] ABSTRACT

A molded plastic, folding hanger for displaying garments has a polygonal outer frame shaped to support a garment to which outer frame an inner garment supporting frame is pivotally secured by an integral hinge whereby the inner garment supporting frame can be pivoted from a storage position nested within the outer frame to a garment display position in which it depends from and below the outer frame. The inner frame is so designed that the support hook for the hanger can be pivoted into a storage position within the silhouette of the outer frame when the hanger is not in use.

11 Claims, 4 Drawing Sheets

FOLDABLE GARMENT DISPLAY DEVICE

SUMMARY OF THE INVENTION

A garment display hanger suitable for a wide variety of children's garments is made with an open primary frame and an integral secondary frame which, unless needed, remains folded into the silhouette of the primary frame and, when needed, depends from and below the primary frame.

BACKGROUND OF THE INVENTION

Because hangers designed for children's garments are normally used for a variety of garments and also because many of the garments consist of a set including two or more coordinated garments which should be displayed together, the hangers preferably should have the capacity to hang and properly display a variety of garments of different designs. It is also necessary that the cost of the hanger be kept low and that it be capable of economical shipment. When fully extended to accommodate the various types of garments with which they are designed for use, these hangers are bulky and expensive to ship and store. In this condition, they are large, awkward to ship or store and because the clothing to be displayed is smaller and lighter in weight than adult clothing, can be designed to use a thinner and less sturdy structure. This is important in keeping material costs down. However, their overall size greatly increases molding costs, as well as shipping and storage costs This invention provides a hanger construction which has the capability of functional variety which can also be folded into a reasonably compact and convenient shape for shipment and storage.

BRIEF DESCRIPTION OF THE INVENTION

The hanger of this invention has a main frame of a opening. The top member of the frame has a hook hinged to its central portion so it can be folded to storage position within the outline of the frame or pivoted into erected position extending upwardly where it can be used to suspend the frame. Inside the main frame is a secondary frame the top of which is hinged to the bottom member of the main frame so it can be shipped and stored while folded into the space surrounded by the main frame. Both frames have inwardly extending members which provide additional means of holding various types of garments for display, storage, drying or any other purpose. In certain embodiments, the entire frame may be molded as a single, one-piece, integral product from suitable synthetic resin materials.

DESCRIPTION OF THE PREFERRED EMBODIMENT

Figure 1:
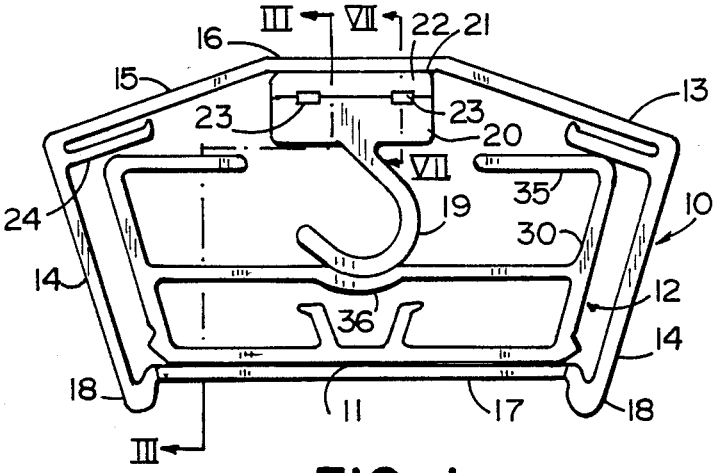
FIG. 1 is a front elevation view of the garment hanger of this invention in folded, storage condition.

The numeral 10 identifies an outer or primary frame having a generally overall trapezoidal shape which is connected by a hinge 11 to an inner or secondary frame 12. The secondary frame is also of generally trapezoidal configuration.

The primary frame 10 has an outer member 13 defining its periphery, the sides 14 of which are inclined downwardly toward each other. At their upper ends, the sides 14 are connected by a top member 15 which has an arched or convex shape with a straight central section 16. The sides 14 are connected to the member 17 through a pair of downwardly extending legs 18.

A hook 19, having an information or display panel 20 at its base, is pivotally connected to the primary frame 10 by a hinge 21. The hinge joins the edge of the panel 20, which is at the bottom when the hook is erected, to the lower or inner edge of the central section 16 of the top member 15.

Figure 6:
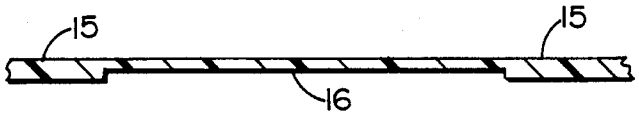
FIG. 6 is a fragmentary sectional view taken along the plane VI—VI of FIG. 5.
Figure 5:
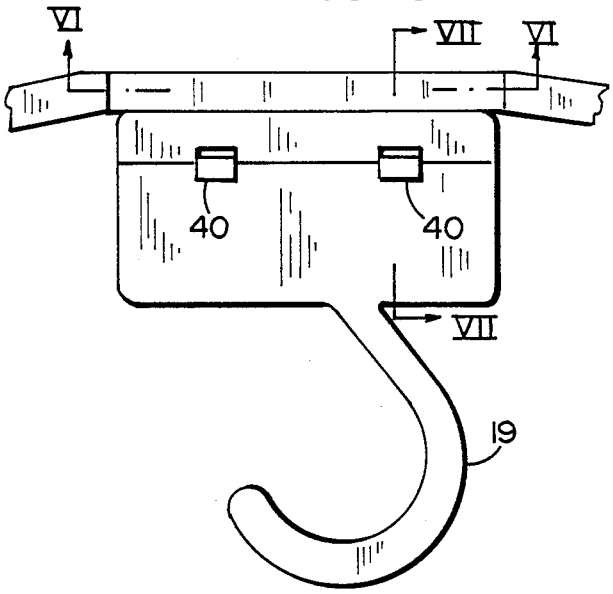
FIG. 5 is an enlarged fragmentary rear view of the support hook in storage position.
Figure 7:
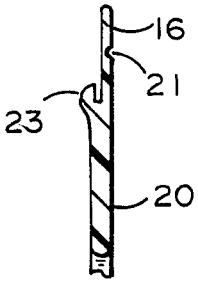
FIG. 7 is a sectional view taken along the plane VII—VII of FIG. 5.

In the area spanned by the panel 20, the thickness of the top member 15 is reduced (FIG. 6). In a similar manner, the thickness of the panel is reduced at 22. Preferably, each is reduced by a half whereby, when the hook is erected, the total thickness in the panel area is the same as that of the rest of the top member 15. When the hook is erected, a latch finger 23 seats over the top of the top member. The plastic from which the hanger is molded provides enough elasticity to permit the latch finger 23 to be engaged and disengaged.

The secondary frame, where it hinges to the primary frame, has a construction similar to that of the primary frame in the area of the hook. Both the frame's cross member 31, which seats against the bottom member 17 of the primary frame and the member 17 are half the thickness of the frame so the two can seat face to face with a total thickness equal to that of the sides of the frame. The two frames are joined by the hinge 11 which is at the top of both the bottom member of the primary frame and the top member of the secondary frame.

The primary frame also has a pair of inwardly extending fingers 24 which are integral with the sides 14 and closely adjacent to and parallel with the adjacent portions of the top 15. The ends 25 of the fingers are preferably turned upwardly to retain garments hung on the fingers. The ends of the upturned portions are sufficiently spaced from the top 15 that the straps of a garment can be passed between them and the top 15.

The secondary frame 12 has a pair of end members 30 joined by the first cross member 31 and by a second cross member 32. The cross members are parallel. The cross member 34, which is uppermost when the secondary frame is folded into storage position, is discontinuous and forms a pair of inwardly extending short arms 35. The gap between the ends of the arms provides space to receive the hook 19 when it is folded to storage position. In the particular construction illustrated, the central portion of the second cross member 32 has an offset 36 to provide clearance for the hook 19. The primary purpose of this cross member is to serve as a brace for the end members 30 since the peripheral element of the frame formed by the arms 35 has a gap. The first cross member 31 has a pair of divergent limbs 37 each having an outwardly extending projection at its end. The limbs are centered about the hanger's vertical centerline. These can be used to hold a garment by the waist, the other end of the waist of which garment has been wrapped around the opposite end member 30.

Figure 8:
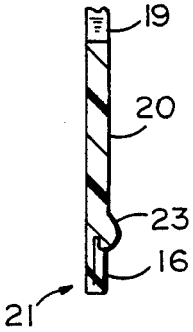
FIG. 8 is a sectional view taken along the same plane as FIG. 7 illustrating the hook in erected and latched position.

FIGS. 5–8 illustrate a latching system for holding the hook 19 in erected position. In this construction the hook is provided with a latch member 40, and preferably with a pair of the latch members, as illustrated. Due to the resilience of the plastic, the latches can be snapped over the top of the central section 16 of the primary frame to secure the hook in erected position as illustrated in FIG. 8.

Figure 10:
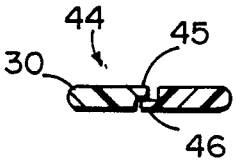
FIG. 10 is a sectional view taken along the plane X—X of FIG. 9.
Figure 9:
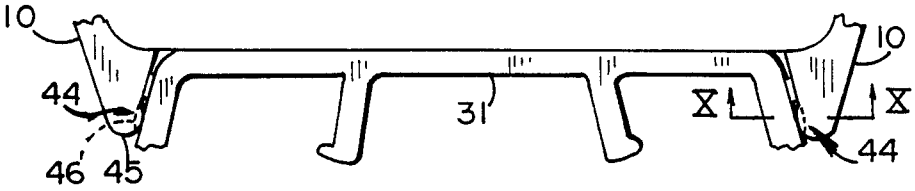
FIG. 9 is an enlarged, fragmentary view of the juncture of the primary and secondary frames of the hanger illustrated in FIGS. 1 and 2.

A latching mechanism can also be provided to stabilize the open position of the secondary frame 12 as illustrated in FIGS. 9 and 10. In this construction, a latch system 44 is provided to hold the secondary frame in open position. This latch is provided on each side and each consists of a pair of projections 45 and 46 which extend toward each other, one 45 extending outwardly from the side of the secondary frame and the other 46 extending inwardly from the inner edge of each of the legs 18 (FIGS. 9 and 10). These projections have rounded ends to facilitate being pushed past each other as they are moved into locked position. Again, the limited resilience of the plastic permits this to be done. This resilience also permits the fingers to be unlatched, if the secondary frame is to be folded back for storage.

The entire hanger is molded as a single, integral product in the folded condition illustrated in FIG. 1. The hanger's design permits this and the fact that this can be done materially reduces the size of the mold required to make the hanger. This also reduces cycle time because the mold has less mass to heat and cool. This is an important factor in keeping the cost of the hanger within an acceptable range. The hanger can be molded from a number of plastics. A preferred resin is polypropolyene because of its ability to be flexed and thus serve as a hinge without significant fatigue over an extended period of repeated use.

Figure 11:
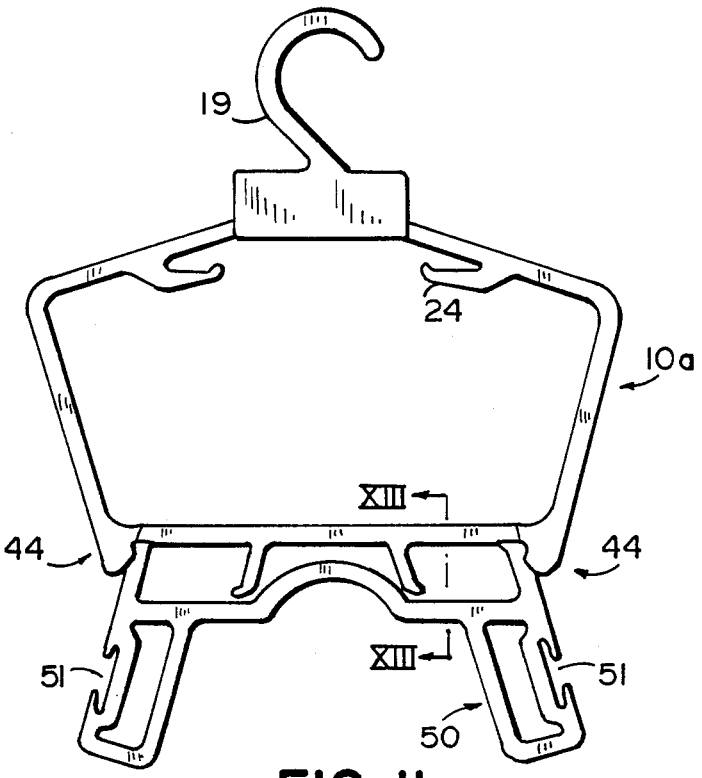
FIG. 11 is a view similar to FIG. 1 illustrating a modified construction for the hanger in folded condition.
Figure 12:
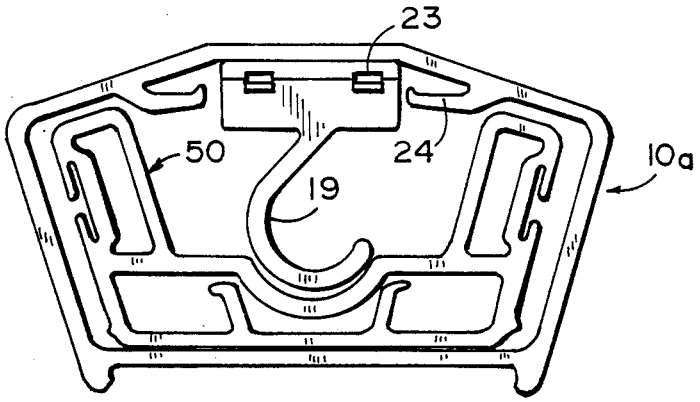
FIG. 12 is a front view of the hanger illustrated in FIG. 11 in open position.
Figure 13:
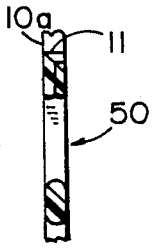
FIG. 13 is a sectional elevation view taken along the plane XII—XII of FIG. 11.

A modified construction is illustrated in FIGS. 11, 12 and 13. The outer or primary frame 10*a* is very similar to the primary frame 10 except the fingers 24 are relocated closer to the center of the frame. The inner or secondary frame 50 is of a substantially different construction. It is configured to provide support for a different group of garments and thus has hook slots 51 on the outside. The identical hinge arrangement 11 is provided for joining the primary and secondary frames as is utilized for the hanger illustrated in FIGS. 1 and 2. It also uses the same latching system 44 for holding the secondary frame in open position as that used with the hanger illustrated in FIGS. 1, 2, 9 and 10.

Figure 2:
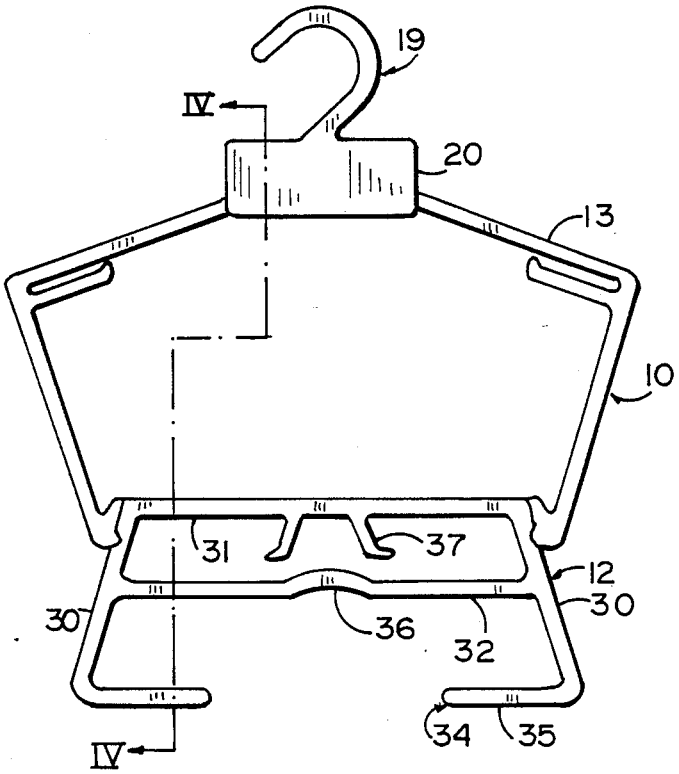
FIG. 2 is a view similar to FIG. 1 illustrating the hanger after opening.
Figure 3:
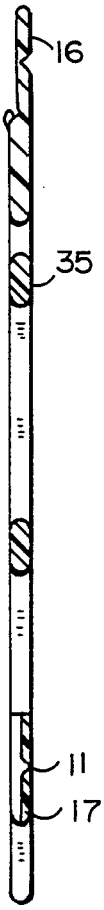
FIG. 3 is an enlarged sectional elevation view taken along the plane III—III of FIG. 1.
Figure 4:
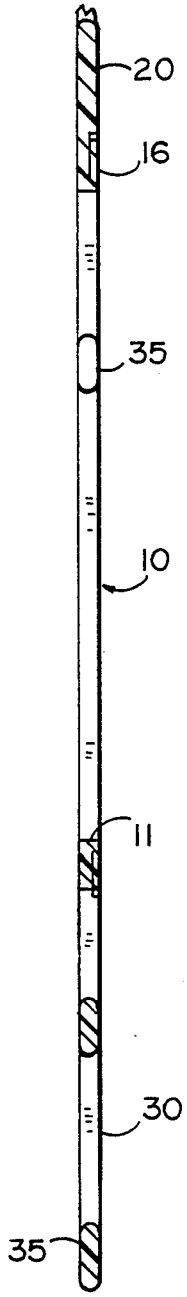
FIG. 4 is a sectional elevation view taken along the plane IV—IV of FIG. 2.
Figure 14:
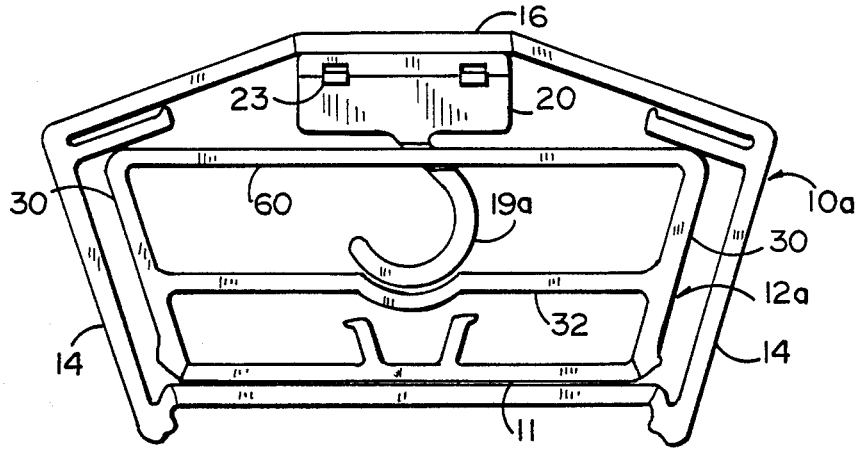
FIG. 14 is a front elevation view similar to FIG. 1 of a modified construction for the hanger.
Figure 15:
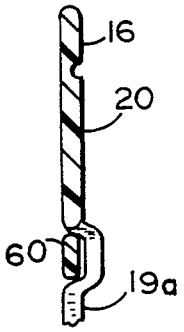
FIG. 15 is an enlarged fragmentary sectional elevation view taken along the plane XV—XV of FIG. 14.

A further modified construction is illustrated in FIGS. 14 and 15. In this construction, the short arms 35 of the hanger illustrated in FIGS. 1 and 2 are replaced by a continuous bar 60 extending from one end member 30 to the other of the secondary frame 120. This arrangement greatly strengthens and stiffens the secondary frame. This also provides a continuous bar over which a garment can be draped. The use of the continuous bar 60 is made possible by providing an offset 61 in the hook 19*a* through which the bar can pass when the hook is folded into storage position (FIGS. 14 and 15). In this construction, the second cross member 32 could be eliminated because one of its primary functions, that of bracing the end members 30, is largely eliminated by closure of the gap in the bar 60.

Figure 16:
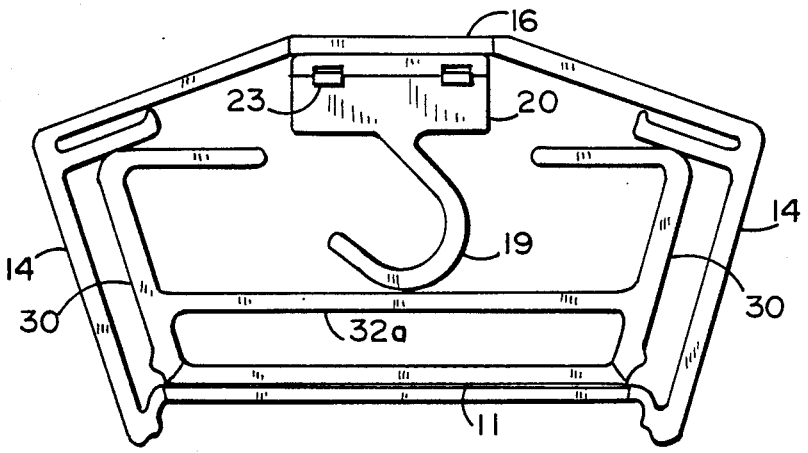
FIG. 16 is a front elevation view of a further modified construction for the hanger.

A still further modification is illustrated in FIG. 16 in which the hanger is designed with the cross member 32*a* moved closer to the cross member 31 sufficiently that the offset 36 in cross member 32 is no longer necessary. The fact that this reduces the ability of the cross member to support the end member 12 can be compensated by using the hanger for lighter, less demanding articles.

A still further modification is illustrated in FIG. 16 in which the hanger is designed with the cross member 32*a* moved closer to the cross member 31 sufficiently that the offset 36 in cross member 32 is no longer necessary. The fact that this reduces the ability of the cross member to support the end member 12 can be compensated either by using the hanger for lighter, less demanding garments or the wall thickness of the end members 30 can be increased to stiffen them.

This invention provides a hanger capable of supporting and attractively displaying a variety of garments. Its manufacturing cost can be kept competitive because it is capable of being molded in a simple two-part mold without the use of mold parts or cams which have to be withdrawn during molding in order to release the product. For the size of the hanger, it permits the use of a compact mold. The design of the hanger provides a hanger with strength and versatility of use, utilizing a minimum of plastic.

Having described a preferred embodiment of the invention and modifications thereof, it will be understood that other modifications of this invention can be made without departing from the invention's purpose. Such modifications are to be considered as included in the hereinafter appended claims, unless these claims, by their express language, state otherwise.

I claim:

1. A garment hanger having primary and secondary body portions, said primary body portion having top, bottom and side members forming a polygon, surrounding and defining the perimeter of a central open space, said secondary body portion having members defining a pair of sides, a bottom and portions of a top and surrounding and defining the perimeter of a second open space, the size and shape of said second body portion being such that it can be received within the central space of said primary body portion, hinge means joining said primary and secondary body portions at the top of the bottom member of said secondary body portion, whereby said secondary body portion can be pivoted from a storage position within said central space of said primary portion to a garment receiving position wherein said secondary body portion is below and depends from said primary body portion.

2. A garment hanger having a primary body portion and a secondary body portion, said primary body portion having a top portion from the ends of which depend a pair of side members, a bottom member connecting the lower ends of said side members, said arms, side members and bottom member defining the perimeter of a central polygonal space, said secondary body portion having peripheral elements arranged in a configuration of a shape and size to be received within said central space, hinge means joining one of said peripheral elements of said secondary body portion to the bottom member of said primary body portion whereby said secondary body portion can be pivoted from a storage position within said central space to a garment receiving position wherein said secondary body portion is below and depends from said primary body portion.

3. A garment hanger having upper and lower frame members, said upper frame member having a polygonal shaped peripheral element surrounding a central space, said lower frame member being shaped to be received within said central space; said upper and lower frame members being hingedly joined by means at the lower edge of said upper frame member whereby it can be pivoted between storage and garment receiving positions and in said latter position it is dependent from said upper frame member.

4. A garment hanger as described in claim 3 wherein said upper and lower frame members and the hinge are simultaneously molded of plastic as a single integral unit.

5. A garment hanger as described in claim 3 wherein a hook is provided for supporting the hanger, hinge means pivotally connecting said hook to said upper frame member for pivotal movement between an erected position extending outwardly from and parallel to the plane of said upper frame member and a storage position parallel to the same plane and within said central space, said upper and lower frame members and the hinges connecting them and the hook are all simultaneously molded of plastic as a single integral unit with the outer edge of the peripheral element defining the boundary of the hanger as molded.

6. A garment hanger as described in claim 1 wherein latch means are provided for detachably securing said secondary body portion in open position depending from said primary body portion.

7. A garment hanger as described in claim 3 wherein latch means are provided for detachably securing said lower frame to said upper frame member to hold it in said garment receiving position.

8. A garment hanger as described in claim 7 wherein said upper frame member has a pair of dependent legs, said lower frame member being positioned between said legs when in garment receiving position, said latch means being pairs of overlapping fingers, one pair on each side of said lower frame member with one finger of each pair being integral with said lower frame member and the other with one of said legs.

9. A garment hanger as described in claim 3 wherein said upper frame member has a hook for supporting said hanger, hinge means securing said hook to said upper frame member for pivotal movement between a storage position within said central space and erected position extending upwardly from said upper frame member parallel to the plane of the front face of said upper frame member, latch means for detachably securing said hook in its erected position.

10. A garment hanger as described in claim 9 wherein said hinge means connects the lower edge of said hook to the lower edge of the upper frame member's peripheral element, said latch means being a resilient link having one end shaped to seat over the top edge of and grip the opposite face of said upper frame member.

11. A garment hanger as described in claim 10 wherein said hook has a display panel, said hinge means being integral with both said upper frame member and one edge of said display panel, said latch means being integral with said display panel.

* * * * *